US006533836B2

(12) United States Patent
Uenosono et al.

(10) Patent No.: US 6,533,836 B2
(45) Date of Patent: Mar. 18, 2003

(54) IRON-BASED POWDERS FOR POWDER METALLURGY

(75) Inventors: Satoshi Uenosono; Yukiko Ozaki, both of Chiba (JP)

(73) Assignee: Kawasaki Steel Corporation, Kobe (JP)

( * ) Notice: Subject to any disclaimer, the term of this patent is extended or adjusted under 35 U.S.C. 154(b) by 0 days.

(21) Appl. No.: 09/897,396

(22) Filed: Jul. 3, 2001

(65) Prior Publication Data

US 2002/0029657 A1 Mar. 14, 2002

(30) Foreign Application Priority Data

Jul. 7, 2000 (JP) ..... 2000-206373

(51) Int. Cl.[7] ..... B22F 1/02
(52) U.S. Cl. ..... 75/252
(58) Field of Search ..... 75/252

(56) References Cited

U.S. PATENT DOCUMENTS 5,256,185 A * 10/1993 Semel et al. ..... 75/255
5,476,534 A * 12/1995 Ogura et al. ..... 75/252
5,989,304 A * 11/1999 Ozaki et al. ..... 75/252
6,235,076 B1 * 5/2001 Ozaki et al. ..... 75/252
6,355,208 B1 * 3/2002 Unami et al. ..... 419/11

FOREIGN PATENT DOCUMENTS

| | | |
|---|---|---|
| JP | 50-49107 | 5/1975 |
| JP | 59-59810 | 4/1984 |
| JP | 60-36602 | 2/1985 |
| JP | 1-219101 | 9/1989 |
| JP | 3-162502 | 7/1991 |
| JP | 4-210402 | 7/1992 |
| JP | 9-267195 | 10/1997 |
| JP | 3004800 | 11/1999 |

* cited by examiner

*Primary Examiner*—Ngoclan Mai
(74) *Attorney, Agent, or Firm*—Oliff & Berridge, PLC

(57) ABSTRACT

An iron-based mixed powder for use in powder metallurgy and excellent in die filling property and compressibility and without segregation, includes an iron-based powder in which alloying powder(s) is adhered to the surface by a binder and, further, a free lubricant. The iron-based powder includes a mixed iron powder of atomized iron powder and reduced iron powder.

14 Claims, 2 Drawing Sheets

IRON-BASED POWDERS FOR POWDER METALLURGY

BACKGROUND OF THE INVENTION

1. Field of Invention

This invention is directed to iron-based mixed powders for use in metallurgy.

2. Description of Related Art

Iron-based mixed powders for use in powder metallurgy hereinafter also referred to simply as "iron-based mixed powder") are manufactured, generally, by adding: (1) an iron powder for an iron-based powder as a substrate material (which can be a mixture of one or more kinds of iron powder), (2) alloying powder(s) (one or more kinds of alloying powder such as a copper powder, graphite powder and iron phosphide powder), optionally, (3) a lubricant such as zinc stearate (which can be a mixture of one or more kinds of lubricant) and, optionally, (4) machinability improving powder(s) (one or more kinds of machinability improving powder).

However, the iron-based mixed powders described above have a problem that the starting powder, particularly, the alloying powder(s) tends to cause segregation. This is because the iron-based mixed powder contains plural kinds of powder of different sizes, shape and density. Specifically, the distribution of starting powders in the iron-based mixed powder is not uniform during transportation after mixing, charging to a hopper, discharging from the hopper, or upon charging to the mold or during pressing.

For example, it is well-known for the mixed powder of the iron powder and the graphite powder that the iron powder and the graphite powder move and displace independently of each other in a transportation container during track transportation and, as a result, the graphite powder of lower specific gravity floats to the surface and causes segregation. Further, because the mixed powder of the iron powder and the graphite powder charged in the hopper segregates due to movement in the hopper, it is also well-known that the concentration of the graphite powder is different, for example, between each of the initial stage, the middle stage and the final stage of discharging from the hopper.

When the segregated iron-based mixed powder is charged in a mold and pressed into a molding product and the molding product is finally sintered into a sintered body as a final product, the composition fluctuates for every product (sintered product). As a result of the fluctuation of the composition, the size and the strength of products vary greatly to cause failed products.

Further, because each of the alloying powders to be mixed, such as copper powder, graphite powder and iron phosphide powder, is finer than the iron-based powder, the specific surface area of the iron-based mixed powder increases by the mixing of the alloying powder(s) to lower the fluidity of the iron-based mixed powder. Lowering the fluidity of the iron-based mixed powder lowers the charging rate of the iron-based mixed powder into the mold and, therefore, lowers the production speed of the molding product (also referred to as compact powder or green compact).

As a countermeasure for such problems in iron-based mixed powders, as a technique of preventing segregation, Japanese Patent Laid-Open No. 219101/1989, for example, proposes an iron powder for use in powder metallurgy, comprising from 0.3 to 1.3% of a lubricant, from 0.1 to 10% of an alloying element powder and the balance of an iron powder, in which the alloying element powder is adhered on the surface of the iron powder. According to this publication, the iron powder causes no segregation of the ingredients during handling and enables to obtain homogeneous sintered products.

Further, Japanese Patent Laid-Open 162502/1991 discloses a method of manufacturing an iron-based mixed powder for use in powder metallurgy with less segregation of additives and less aging change of the fluidity. The method described in Japanese Patent Laid-Open No. 162502/1991 comprises conducting primary mixing by adding a fatty acid to an iron-based powder, then conducting secondary mixing by adding a metal soap to the alloying powder(s), elevating the temperature during or after the secondary mixing, and then applying cooling during tertiary mixing, thereby adhering the alloying powder(s) to the surface of the iron-based powder by a binding effect of a co-molten product of the fatty acid and the metal soap.

Japanese Patent Publication No. 3004800 discloses an iron-based mixed powder using a binder not containing a metal compound as a binder for the alloying powder(s) to the surface of the iron-based powder. It is described that contamination to a sintering furnace can be reduced by the use of the binder material not containing the metal compound.

However, the iron-based mixed powder applied with the segregation-preventive treatment by each of the publications described above has a problem in the die filling property to a mold and, particularly, has a property that the amount of charge to a narrow width portion of the mold (thin-walled cavity) tends to be decreased.

In view of the above, the present inventors have experimentally confirmed the die filling property of the iron-based mixed powder applied with the segregation-preventive treatment disclosed by the publications described above. First, the result of this experiment is explained as follows.

To an atomized iron powder as the iron-based powder, 2 mass % of a copper powder and 0.8 mass % of a graphite powder as the alloying powder(s), and 0.4 parts by weight of zinc stearate and 0.2 parts by weight of machine oil (spindle oil) as the binder based on 100 parts by weight of the total sum of the iron power and the alloying power, were mixed and heated to adhere the alloying powder(s) to the surface of the iron powder (example of a binder treatment). Then, 0.3 parts by weight of zinc stearate was mixed with these components as a free lubricant. An iron-based mixed powder including a mixture of an iron powder and a free lubricant, in which alloying powder(s) is adhered on the surface of the iron powder (known product), was obtained by this treatment. 150 g of the iron-based mixed powder was charged in a shoe box sized 20 mm×60 mm×100 mm, as shown in FIG. 1.

The shoe box was moved in a direction to a mold at a speed of 200 mm/s, stood stationary just above the mold for 1 second, and then retracted to the original position in the arrangement, as shown in FIG. 1. The iron-based mixed powder was charged into the mold by the operation. The mold used has a cavity with a thickness of T mm, length, L, of 60 mm and depth, D, of 60 mm. The thickness T mm was varied as 1, 2 and 5 mm.

After charging, the iron-based mixed powder charged in the cavity was molded at a pressure of 488 MPa and the weight of the obtained molding product was measured. Then, the charged density (=the molding product weight/mold volume) was calculated to evaluate the die filling property of the iron-based mixed powder to the mold. The result for the iron-based mixed powder (known product) is shown in FIG. 2. It can be seen from FIG. 2 that the charged density decreases as the cavity thickness T of the mold decreases in the known product. For example, when the cavity thickness T of the mold is 1 mm, the existent iron-based mixed powder is charged by less than one-half for the apparent density. As described above, when the cavity thickness of the mold is thin, die filling property of the iron-based mixed powder treated for segregation by the known techniques is deteriorated.

In the known product of the reduced die filling property as described above, when it is charged into a mold, for example, of a gear shape, the charged density is lower at a narrow width portion of the tooth tip as compared with other portions of the gear. Then, when it is pressurized as it is into the molding product and further sintered, because the amount of shrinkage differs depending on the portions, the dimensional accuracy of a part is deteriorated. Generally, when the charged density is different and the green density is different for different portions, the rate of dimensional change upon sintering also differs and, further, the sintering density is also different. Accordingly, in the portion at the tooth tip of the gear of low charged density, the sintering density tends to be lowered and, thus, the strength is lowered. Because maximum stress is usually exerted on the portion of the tooth tip in the gear, it is required that the portion for the tooth tip has a higher strength and, preferably, the charged density is preferably higher.

In view of the problems described above, Japanese Patent Laid-Open No. 267195/1997 discloses, for example, a powder charging method comprising disposing a pipe having gas releasing holes at the surface in a shoe box, fluidizing a powder by the gas exiting from the gas releasing holes, and then charging the powder gravitationally into the cavity. However, because the technique described in Japanese Patent Laid-Open No. 267195/1997 requires a special apparatus, it has a problem of increasing the installation cost and also increasing the manufacturing cost.

Further, in the field of sintered parts for use in automobiles, for instance, reduction of size for sintered parts is desired along with a demand for the weight reduction of car bodies in recent years. However, stress exerted on parts tends to be increased along with the size reduction of the parts. Accordingly, for the parts of identical composition, those parts of higher strength, namely, those parts of higher density are desired (for sintered products of an identical composition, the strength is generally higher as the density is higher). In order to obtain a sintered part of a reduced size and having high density, it is necessary that the iron-based mixed powder is applied with the segregation-preventive treatment and is excellent in compressibility. In addition, it is required for an iron-based mixed powder that it is excellent in the die filling property to the narrower width portion of the mold, as well as it having the characteristics described above.

SUMMARY OF THE INVENTION

This invention can advantageously overcome the problems of known powders described above and provide an iron-based mixed powder capable of manufacturing sintered parts of consistent high density and with less fluctuation of characteristics. Specifically, it intends to provide an iron-based mixed powder applied with a segregation-preventive treatment and excellent in the compressibility (high density for the molding product) and excellent in the die filling property.

The present inventors have made an earnest study in order to solve the foregoing problems of various factors affecting the compressibility and the die filling property of the iron-based mixed powder applied with the segregation-preventive treatment (for example, a binder treatment).

First, the iron-based powder is generally classified into two types of powder; namely, an atomized iron powder and a reduced iron powder. The reduced iron powder has greater unevenness on the surface and more voids in the iron powder as compared with the atomized iron powder. Accordingly, it is well-known that iron-based mixed powder using reduced iron powder has lower compressibility and poor fluidity (flow rate) compared with those using atomized iron powder. While the fluidity and the die filling property are not an identical property, it can be generally anticipated that good fluidity will be advantageous for die filling property. Further, the iron-based mixed powder of excellent fluidity can be industrially handled more easily.

Accordingly, for obtaining high sintered density required generally for sintered parts, atomized iron powders excellent in compressibility and fluidity of the mixed powder have usually been used as the iron-based powders (reduced iron powder may exceptionally be used in bearing parts in order to utilize the oil-preserving effect of voids).

As a result of the study, the present inventors have found that the iron-based mixed powder using reduced iron powder is more excellent than iron-based mixed powder using atomized iron powder with respect to the die filling property to the mold having a narrow cavity, contrary to the analogy from the fluidity.

On the other hand, it is difficult to obtain a sufficient compressibility in iron-based mixed powder using reduced iron powder as the iron-based powder. The present inventors have made a further study and discovered that the die filling property of the iron-based mixed powder can be improved remarkably with no significant lowering of the compressibility by mixing an appropriate amount of reduced iron powder to atomized iron powder as a main component. The present inventors have further found that use of an appropriate binder and a lubricant can also further improve the die filling property.

An example of the die filling property of the iron-based mixed powder according to this invention is shown in FIG. 2 as the inventive product. The iron-based mixed powder according to this invention (inventive product) can be charged well even for a cavity thickness of 1 mm, and it can be seen that the die filling property is remarkably improved compared with the known product.

This invention has been accomplished based on the findings described above and as a result of a further study.

That is, this invention provides an iron-based mixed powder for use in powder metallurgy that has excellent die filling property, comprising an iron-based powder, alloying powder(s), a binder and, optionally, a machinability improving powder(s) and, preferably, further containing a free lubricant. The iron-based powder comprises from about 60% to about 90% of an atomized iron powder and from about 10% to about 40% of a reduced iron powder on a mass % basis, based on the entire amount of the iron-based powder (preferably, the balance excepting the atomized iron powder substantially comprising the reduced iron powder), and the alloying powder(s) and, optionally, the machinability improving powder(s) are adhered by the binder to the surface of the iron-based powder.

Further, in the invention described above, it is preferred that the reduced iron powder used for the iron-based powder is present as a free iron-based powder (iron-based powder with no alloying powder or the machinability improving powder adhered on the surface) in an amount of from about 10% to about 30% for the entire amount of the iron-based powder. For this purpose, the free iron-based powder may be mixed after the binder treatment.

Further, in the invention, the content of the binder is preferably from about 0.1 parts by weight to about 1.0 parts by weight based on 100% by weight of the total amount for the iron-based powder, alloying powder(s) and the machinability improving powder(s).

Further, in this invention, the binder is preferably one or more members selected from stearic acid, oleamide, stearamide, a melted mixture of stearamide and ethylenbis (stearamide) and ethylenbis(stearamide).

Further, in this invention, the binder may comprise one or more of members selected from oleic acid, spindle oil and turbine oil, and zinc stearate.

Further, in this invention, the content of the free lubricant is preferably from about 0.1 parts to about 0.8 parts by weight based 100 parts by weight of the total amount for the iron-based powder, the alloying powder(s) and the machinability improving powder(s).

Furthermore, in this invention, the free lubricant preferably comprises one or more members selected from a thermoplastic resin powder, zinc stearate and lithium stearate, or, optionally, contains one or more members selected from stearic acid, oleamide, stearamide, a melted mixture of stearamide and ethylenbis(stearamide), ethylenbis(stearamide), polyethylene with a molecular weight of about 10,000 or less, and a melted mixture of ethylenbis(stearamide) and polyethylene with a molecular weight of about 10,000 or less.

Further in this invention, the thermoplastic resin powder preferably comprises 50 mass % or more, based on the thermoplastic powder, of at least one member selected from acrylic esters, methacrylic esters and the aromatic vinyl compounds as a monomer polymerized therewith, and has a average primary particle size of from about 0.03 $\mu$m to about 5.0 $\mu$m, an average agglomeration particle size of from about 5 $\mu$m to about 50 $\mu$m, and an average molecular weight, measured by a solution specific viscosity method, of from about 30,000 to about 5,000,000.

DETAILED DESCRIPTION OF PREFERRED EMBODIMENTS

Figure 1:
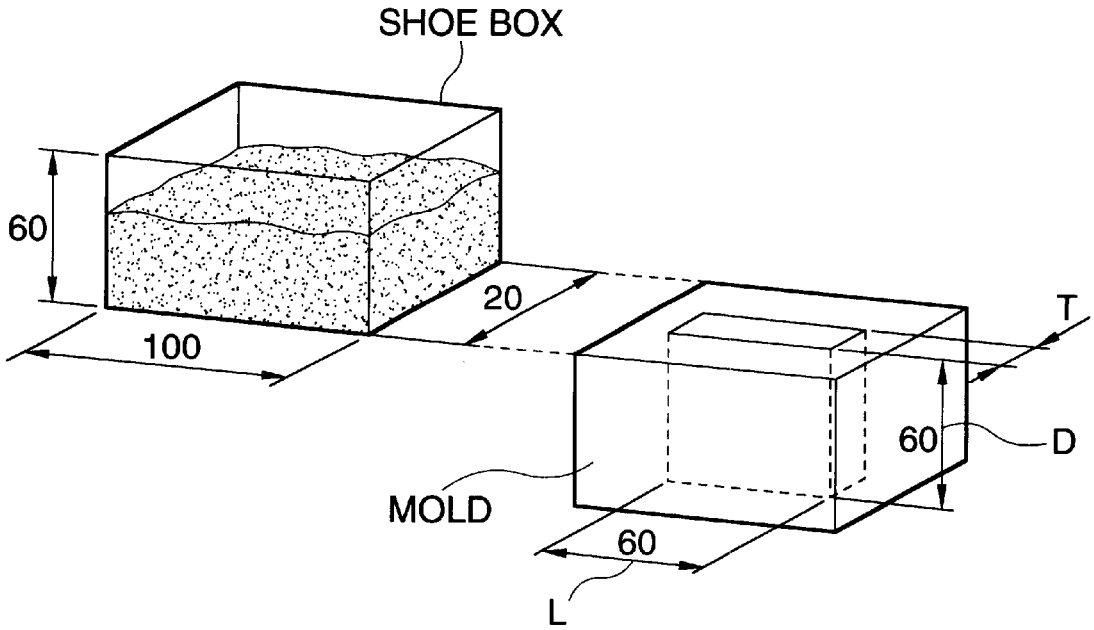
FIG. 1 is a schematic explanatory view showing a test apparatus for a die filling property test.
Figure 2:
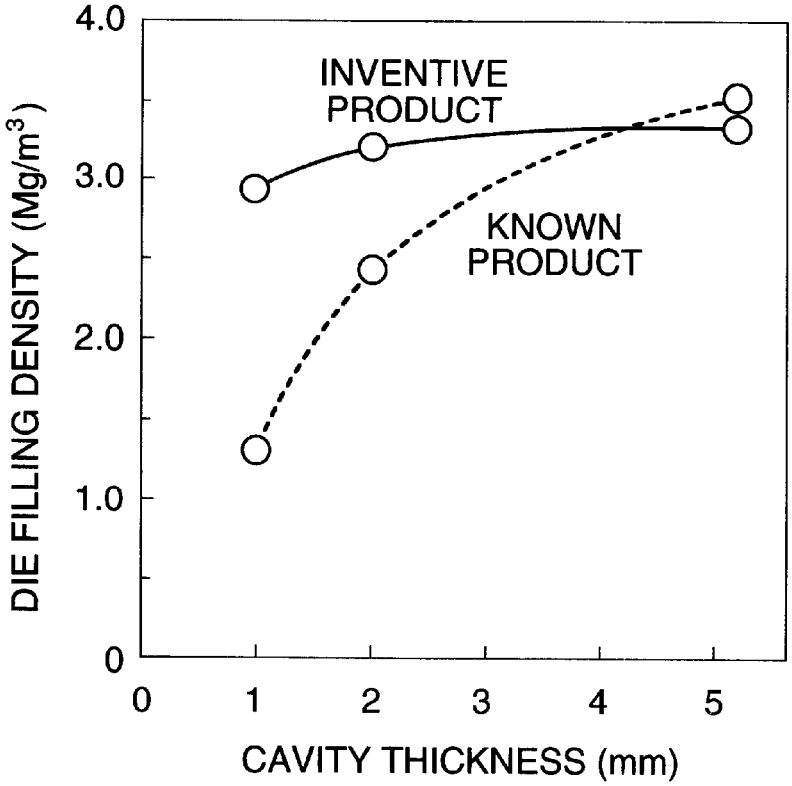
FIG. 2 is a graph illustrating the relationship between a die filling property and the cavity thickness of a mold for a iron-based mixed powder of known iron-based mixed powder (known product) and iron-based mixed powder according to this invention (inventive product)

Iron-based mixed powders for use in powder metallurgy according to this invention comprise an iron-based powder, alloying powder(s), a binder (which can be a mixture of one or more kinds of binder) and, optionally, a lubricant and, further optionally, merchantability improving powder(s) in which the alloying powder(s) or, optionally, the machinability improving powder(s), is adhered by a binder to the surface of the iron-based powder as a segregation-preventive treatment.

According to this invention, the iron-based powder is a mixed iron powder comprising an atomized iron powder as a main ingredient and further comprising from about 40 to about 10 mass % of a reduced iron powder based on the entire amount of the iron-based powder. Preferably, the iron-based powder comprises from about 60 to about 90% of the atomized iron powder and from about 40 to about 10% of the reduced iron powder as the substantial balance based on the entire amount of the iron-based powder. As a result, the die filling property can be improved remarkably without greatly lowering the compressibility. The content of the reduced iron powder is defined as about 40 mass % or less for ensuring satisfactory compressibility of the iron-based mixed powder. More preferably, its content is about 30 mass % or less. Further, the content of the reduced iron powder is defined as about 10 mass % or more for fully obtaining the improving effect for the die filling property. Its content is more preferably about 15 mass % or more. In the iron-based mixed powder according to this invention, it may suffice that the atomized iron powder and the reduced iron powder are merely mixed and it is not necessary that they are metallurgically bonded.

It is further preferred in order to improve the die filling property of the iron-based mixed powder that a portion of the reduced iron powder contained, that is, from about 10 to about 30%, on a mass % basis, of the reduced iron powder based on the entire amount for the iron-based powder, comprise an iron powder having neither alloying powder(s) nor a machinability improving powder(s) adhered on the surface thereof (hereinafter referred to as free iron-based powder). The content of the reduced iron powder as the free iron-based powder is defined as about 10 mass % or more for fully obtaining the improving effect for the die filling property. On the other hand, the content is defined as about 30 mass % or less for ensuring satisfactory compressibility of the iron-based mixed powder. The content of the reduced iron powder as the free iron-based powder is more preferably within a range of from about 15 to about 30 mass %.

The content for the reduced iron powder is defined as about 40 mass % or less for ensuring satisfactory compressibility of the iron-based mixed powder. Further, the content of the reduced iron powder is defined as about 10 mass % or more for fully obtaining the improving effect for the die filling property.

The atomized iron powder mainly used as the iron-based powder in this invention is, preferably, a pure iron powder, or alloy steel powder manufactured from molten metal by an atomizing method, or it may be a mixture of these powders. Further, the atomized iron powder to be used may be a pure iron powder or a partially alloyed steel powder in which alloying powder(s) is partially alloyed on the surface of atomized powder.

Further, for the reduced iron powder used in addition to the atomized iron powder as the iron-based powder, reduced iron powder made of mill scales formed upon manufacture of steel materials, or made of iron ores, is preferably used.

Further, the alloying powder(s) is mixed with the iron-based mixed powder in accordance with desired mechanical characteristics of the sintered product, and various kinds of alloy powders, such as graphite powder, copper powder and nickel powder are preferably used as the alloying powder(s).

The content of the alloying powder(s) is preferably about 5.0 mass % or less based on the total amount including the iron-based powder, alloying powder(s) and the machinability improving powder(s) (mixed optionally) with an aim of ensuring high green density. When the alloy steel powder or the alloyed steel powder is used as the iron-based powder in this invention, the alloy ingredient included therein is not included for the amount of the alloying powder(s) for this purpose.

Further, when it is necessary to improve the machinability of the sintered product, a machinability improving powder(s) is mixed with the iron-based mixed powder. For the machinability improving powder(s), a talc powder, a metal sulfide powder, or the like, is selected in view of the physical property required for the sintered product. The content of the machinability improving powder(s) is preferably about 5.0 mass % or less based on the total amount for the iron-based powder, the alloying powder(s) and the machinability improving powder(s), to ensure a high green density.

Further, in the iron-based mixed powder, a binder is mixed for adhering the alloying powder(s) and, optionally, the machinability improving powder(s), on the surface of the iron-based powder and for preventing segregation.

In this invention, the content of the binder is preferably from about 0.1 parts by weight to about 1.0 parts by weight based on 100 parts by weight of the total amount for the iron-based powder, the alloying powder(s) and the machinability improving powder(s). That is, the binder is preferably used in amount of about 0.1 parts by weight or more to achieve treatment capable of effectively preventing segregation of the alloying powder(s) (binder treatment), and the binder is used preferably in an amount of about 1.0% by weight or less for maintaining a satisfactory die filling property of the iron-based mixed powder.

In this invention, the binder used preferably includes one or more of compounds selected from stearic acid, oleamide, stearamide, a melted mixture of stearamide and ethylenbis (stearamide) and ethylenbis(stearamide) (binder A). The binder A used preferably may be one or more members selected from stearic acid, oleamide, stearamide, a melted mixture of stearamide and ethylenbis(stearamide) and ethylenbis(stearamide), which is melted by heating.

Further, in this invention, a binder comprising zinc stearate and one or more members selected from oleic acid, spindle oil and the turbine oil may be used (binder B). As the binder B, zinc stearate and one or more members selected from oleic acid, spindle oil and turbine oil, which are melted by heating may be used.

Further, the iron-based mixed powder is usually mixed with a lubricant with an aim of improving the fluidity of the iron-based mixed powder and the die filling property to the mold, as well as with an aim of lowering ejection force by being melted or softened by the heat of friction upon pressing the iron-based mixed powder in a mold.

For obtaining such an effect of the lubricant, at least some amount of the lubricant is present as a free lubricant. The "free lubricant" referred to in this invention means a lubricant that is not bonded with the iron-based powder (iron powder), the alloying powder(s), or the machinability improving powder(s) in the iron-based mixed powder, but rather is present in a free state. The content of the free lubricant is preferably from about 0.1 parts by weight to about 0.8 parts by weight, based on 100 parts by weight of the total amount for the iron-based powder, alloying powder (s)and the machinability improving powder(s). When the free lubricant is about 0.1 parts by weight or more, the die filling property of the iron-based mixed powder can be improved further. When the content of the free lubricant is about 0.8 parts by weight or less and, more preferably, about 0.5 parts by weight or less, satisfactory die filling property and high molding product density can be achieved.

In this invention, use of one or more members selected from a thermoplastic resin powder, zinc stearate and lithium stearate as the free lubricant is preferred. As the free lubricant, it is also preferred to use one or more members selected from a thermoplastic resin powder, zinc stearate and lithium stearate, incorporated further with one or more members selected from stearic acid, oleamide, stearamide, a melted mixture of stearamide and ethylenbis(stearamide), ethylenbis(stearamide), polyethylene with a molecular weight of about 10,000 or less and a melted mixture of ethylenbis(stearamide) and a polyethylene with a molecular weight of about 10,000 or less.

When one or more members selected from thermoplastic resin, zinc stearate and lithium stearate is incorporated as the free lubricant, the die filling property of the iron-based mixed powder is improved remarkably. Further, the content of one or more members selected from thermoplastic resin, zinc stearate and lithium stearate is preferably about 0.05 parts by weight to about 0.8 parts by weight, more preferably, from about 0.1 parts by weight to about 0.5 parts by weight based on 100 parts by weight of the total amount for the iron-based powder, alloying powder(s)and the machinability improving powder(s) (added optionally) in view of the improvement for the fluidity and the die filling property into the mold of the iron-based mixed powder.

Further, the thermoplastic resin powder preferably contains 50 mass % or more of at least one member selected from acrylic esters, methacrylic esters and aromatic vinyl compounds (each as monomer) based on the entire amount of the thermoplastic resin powder, which is polymerized therewith. When the content of at least one member selected from the acrylic esters, methacrylic esters and aromatic vinyl compounds as the monomer is 50 mass % or more based on the entire amount of the thermoplastic resin powder, the fluidity of the iron-based mixed powder is improved sufficiently. As the monomer, one of the acrylic esters, methacrylic esters and aromatic vinyl compounds may be used alone or two or more of them may be used in combination.

The acrylic ester can include, for example, methyl acrylate, ethyl acrylate, n-propyl acrylate, isopropyl acrylate, n-butyl acrylate, isobutyl acrylate, sec-butyl acrylate, t-butyl acrylate, n-hexyl acrylate, cyclohexyl acrylate, 2-ethylhexyl acrylate and n-octyl acrylate.

Further, the methacrylic ester can include, for example, methyl methacrylate, ethyl methacrylate, n-propyl methacrylate, isopropyl methacrylate, n-butyl methacrylate, isobutyl methacrylate, n-hexyl methacrylate, cyclohexyl methacrylate, 2-ethylhexyl methacrylate and n-octyl methacrylate. Among the monomers described above, methyl methacrylate can be used particularly suitably.

Further, the aromatic vinyl compound can include, for example, monomers such as styrene, α-methylstyrene and divinylbenzene. Further, monomers having a methyl group, ethyl group, propyl group or butyl group substituted on the benzene ring of the monomer described above, for example, vinyl toluene or isobutyl styrene can also be included in the aromatic vinyl compound.

Further, at least one monomers from acrylic esters, methacrylic esters and aromatic vinyl compounds may be incorporated and copolymerized with other copolymerizable monomer in an amount preferably by about 50 mass % or less based on the entire amount of the monomer to form a thermoplastic resin.

Other monomers copolymerizable with the three kinds of monomers described above can include, for example, unsaturated monomocarboxylic acids, such as acrylc acid, methacrylic acid, 2-ethyl acrylic acid, crotonic acid, and cinnamic acid; unsaturated dicarboxylic acid, such as maleic acid, itaconic acid, fumaric acid, citraconic acid, and chloromaleic acid, as well as anhydrides thereof, monoesters of unsaturated dicarboxylic acids, such as monomethyl maleate, monobutyl maleate, monomethyl fumarate, monoethyl fumarate, monomethyl itaconate, monoethyl itaconate and monobuthyl itaconate, as well as derivatives thereof; glycidyl ethers, such as glycidylmethacrylate, glycidylacrylate, glytcidyl-p-vinylbenzoate, methylglycidylitaconate, ethylglycidylmaleate and glycidylvinylsulfonate; epoxide olefins, such as butadiene monoxide, vinylcyclohexene monoxide, 5,6-epoxyhexene, and 2-methyl-5,6-epoxyhexene; vinyl cyanides such as acrylonitrile and methacrylonitrile; vinyl esters, such as vinyl acetate, vinyl propionate, vinyl myristate, vinyl oleate and vinyl benzoate; conjugated diene compounds, such as budadiene, isoprene, 1,3-pentadiene and cyclopentadiene; and non-conjugated diene compounds, such as 1,4-hexadiene, dicyclopentadiene and ethylidenenorbornene.

Further, as the copolymerizable monomer, a crosslinking monomer having two or more double bonds substantially equal in view of the reactivity may be added by from about 0.1 to about 2 mass % based on the entire amount of the monomer. The crosslinking monomer can include, for example, ethyleneglycol diacrylate, ethyleneglycol dimethacrylate, butyleneglycol diacrylate, butyleneglycol dimethacrylate, trimethylolpropane diacrylate, trimethylolpropane dimethacrylate, trimethylolpropane triacrylate, trimethylolpropane trimethacrylate, hexanediol diacrylate, hexanediol dimethacrylate, oligoxyethylene diacrylate and oligoxyethylene dimethacrylate, as well as aromatic divinyl monomers, such as divinylbenzene, triallyl trimeritate and triallyl isocyanurate.

The thermoplastic resin powder described above preferably has an average primary particle size of from about 0.03 μm to about 5.0 μm, an average agglomeration particle size of from about 5 μm to about 50 μm, and an average molecular weight, as measured by a solution specific viscosity method, of from about 30,000 to about 5,000,000.

Figure 3:
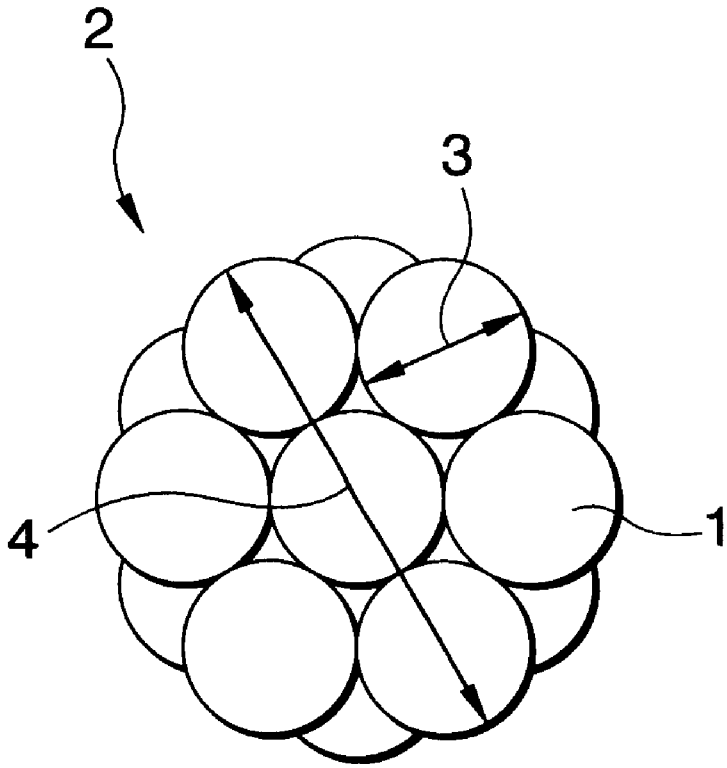
FIG. 3 is an explanatory view illustrating the definition for the primary particle size and the agglomeration particle size.

The average primary particle size referred to in this invention means an average size value 3 for the individual particles or primary particles 1 of the thermoplastic resin powder, as shown in FIG. 3. Further, the average agglomeration particle size means an average value 4 for the particle size of the agglomerated particle 2 formed by cohesion of primary particles 1. The average primary particle size is obtained by observing agglomerated particles by a scanning electron microscope (SEM), actually measuring the diameter (primary particle size) for about 50 of primary particles forming the agglomerated particle and averaging the same. Further, the average agglomeration particle size is obtained by observing the agglomerated particle by the SEM in the same manner and measuring the particle size for about 50 of the agglomerated particles based on the SEM photograph and averaging the same.

Further, in this invention, the average molecular weight is measured by a solution specific viscosity method. Measurement by the solution specific viscosity method is conducted by the following procedures. 0.2 g of a specimen resin is dissolved in 50 ml of tetrahydrofuran, to determine the viscosity A of the solution at 35° C. In the same manner, the viscosity B of a solvent (tetrahydrofuran) at an identical temperature is determined to calculate a specific viscosity (A/B). Because the relation for the specific viscosity—average molecular weight is previously determined from various kinds of standard polystyrenes, the average molecular weight of the specimen resin is determined based on the specific viscosity described above using the relation.

The average primary particle size of the thermoplastic resin powder is preferably from about 0.03 μm to about 5.0 μm. When the average primary particle size is about 0.03 μm or more, the manufacturing cost of the resin powder is not expensive, so that the production cost for the iron-based mixed powder can be prevented from increasing. The particle size is further preferably about 0.05 μm or more. Further, when it is defined as about 5.0 μm or less, the density of the molding product can be kept high (that is, the compressibility can be maintained satisfactorily). It is further preferably about 3.0 μm or less.

The average agglomeration particle size of the thermoplastic resin powder is preferably from about 5 μm to about 50 μm. When the average agglomeration particle size is about 5 μm or more, the fluidity and the hopper dischargeability of the iron-based mixed powder can be maintained satisfactory. The average agglomeration particle size is further preferably about 10 μm or more. Further, when this particle size is about 50 μm or less, the tensile strength of the sintered product can be kept equal to or greater than that of the known product. This particle size is further preferably about 40 μm or less.

Further, as the thermoplastic resin powder, two or more kinds of thermoplastic resin powders of different average primary particle size can be mixed. In this case, the mixing ratio is preferably controlled such that the average primary particle size of the mixed powder can satisfy the preferred condition for the average primary particle size described above.

Further, the average molecular weight of the thermoplastic resin powder measured by the solution specific viscosity method is preferably from about 30,000 to about 5,000,000. When the average molecular weight is about 30,000 or more, the manufacturing cost of the resin powder is not expensive but can be suppressed and the production cost of the iron-based mixed powder can be prevented from increasing. Further, when the average molecular weight is about 5,000,000 or less, the fluidity or the hopper dischargeability of the iron-based mixed powder can be maintained substantially equal with or more than that of the existent product.

There is no particular restriction on the manufacturing method of the thermoplastic resin powder described above and any of several methods used so far for the manufacture of fine resin powder such as of polymethyl methacrylate is suitable. Among the methods, a polymerization method of not reducing the particle size to extremely fine size and capable of obtaining spherical particles, for example, a micro-suspension polymerization method, an emulsion polymerization method and a seeding emulsion polymerization method are particularly preferred.

As the micro-suspension polymerization method, it is suitable to use a method of using an oil soluble initiator as a radical polymerization initiator, previously controlling the particle size of monomer oil droplets by homogenization (into uniformity) before starting of the polymerization and conducting polymerization in a homogeneously dispersed state.

The oil soluble radical polymerization initiator usable herein can include, for example, benzoyl peroxide, diacyl peroxides such as di-3,5,5-trimethylhexanoyl peroxide and dilauloyl peroxide; peroxydicarbonates, such as diisopropylperoxy dicarbonate, di-sec-butylperoxy dicarbonate, and di-2-ethylhexylperoxy dicarbonate; peroxyesters, such as t-butylperoxypivalate and t-butylperoxyneodecanoate; organic peroxides, such as acetylcyclohexylsulfonyl peroxide and disuccinic acid peroxide; and azo compounds, such as 2,2'-azobisisobutyronitrile, 2,2'-azobis-2-methylbutyronitrile, and 2,2'-azobisdimethylvaleronitrile.

Further, such radical polymerization initiators may be used alone or two or more of them may be used in combination. The amount of use can be properly selected depending on the kind and the amount of the monomer and the charging method and usually it is preferably used within a range of from about 0.001 to about 5.0 parts by weight based on 100 parts by weight of the monomer used.

When the micro-suspension polymerization method is practiced, a surface active agent (surfactant) and a dispersant agent are used usually.

Surface active agent can include, for example, anionic surface active agents, for example, alkyl sulfate such as sodium lauryl sulfate and sodium myristyl sulfate; alkylaryl sulfonates, such as sodium dodecylbenzene sulfonate and potassium dodecylbenzene sulfonate; sulfosuccinates such as sodium dioctylsulfosuccinate and sodium dihexylsulfosuccinate; salts of fatty acides such as ammonium laurate and potassium stearate; polyoxyethylenealkylsulfate; polyoxyethylenealkylarylsulfate; anionic surfactants such as sodium dodecyldiphenyletherdisulfonate; sorbitan esters, such as sorbitanmonooleate, polyoxyethylenesorbitanmonostearate; polyoxyethylenealkylether; nonionic surfactants such as polyoxyethylenealkylphenylether; and cationic surfactants such as cetylpyridinium chloride and cetyltrimethylammonium bromide.

The dispersant can include, for example, polyvinylalcohol, methylcellulose and polyvinylpyrrolidone.

Such surface active agent and dispersant may be used alone or two or more of them may be used in combination, the amount of use can properly be selected usually within a range from about 0.05 to about 5 parts by weight, preferably, from about 0.2 to about 4 parts by weight based on 100 parts by weight of the monomer used.

Further, in the micro-suspension polymerization method, an oil soluble initiator, a monomer, a surface active agent, as well as polymerization aiding agent, such as higher fatty acids or higher alcohols used optionally and other additives are at first added to an aqueous medium and mixed previously, put to homogenization by a homogenizer to conduct particle size control for oil droplets.

As the homogenizer, for example, a colloid mill, a vibration stirrer, a two stage high pressure pump, high pressure flow emitted from a nozzle or orifice, and supersonic stirring can be utilized. In addition, for control of the oil droplet particle size, appropriate conditions can be selected by a simple preliminary experiment, while this is being effectuated depending on the control for the shearing force upon homogenization, stirring condition during polymerization, reactor type and the amount of the surface active agent and the additives. Then, the homogenization treated solution of the entire monomer is sent to a polymerization vessel and, while elevating the temperature under moderate stirring, polymerization is conducted usually at a temperature ranging from about 30 to about 80° C.

In this way, a liquid emulsion or liquid suspension in which thermoplastic resin powder particles having a desired value for the average primary particle size (for example, 0.03 to 5.0 $\mu$m) are dispersed homogeneously can be obtained. After spray drying the liquid emulsion or the liquid suspension for cohesion of the thermoplastic resin particles, the liquid component is separated by filtration, dried and pulverized to obtain a thermoplastic resin powder. The weight average molecular weight of the thermoplastic resin may be controlled to a predetermined value by the reaction temperature or the polymerization degree controller.

Next, an example of the preferred manufacturing method of the iron-based method powder according to this invention is explained.

First, from about 60% to about 90%, on a mass % basis, of an atomized iron powder, substantially the balance (from about 10 to about 40%) of a reducing iron powder as the iron-based powder, alloying powder(s) and, optionally, a machinability improving powder(s) and a binder are mixed based on the entire amount of the iron base powder to form a mixture.

The binder is preferably mixed from about 0.1 parts by weight to about 1.0 parts by weight or less based on 100 parts by weight of the total amount for the iron-based powder, the alloying powder(s) and the machinability improving powder(s). The binder is preferably one or more of members selected from stearic acid, oleamide, stearamide, a melted mixture of stearamide and ethylenbis (stearamide) and ethylenbis(stearamide).

The mixture is mixed under heating (the process up to this step is referred to as primary mixing). When one kind of binder is used, the heating temperature in the primary mixing is preferably at a temperature higher by from about 10 to about 100° C. than the melting point of the binder. When two or more kinds of the binder are used, the heating temperature is preferably about 10° C. or higher than the lowest value of the melting points of the binders and lower than the highest value among the melting points of the binders. When heating is conducted at a temperature higher than the lower limit temperature described above, at least one kind of binder is melted to provide the binding function by the binder for the powder particles. Further, when the heating temperature is lower than the upper limit described above, reduction of the binding function due to thermodecomposition of the binder or the like can be avoided sufficiently and, satisfactory hopper dischargeability can be maintained.

Then, the primarily mixed powder is cooled to adhere the alloying powder(s) or the machinability improving powder(s) to the surface of the iron-based powder. The processings from the mixing of the starting material powders including the binder up to this step are generally referred to as the binder treatment or adhering treatment.

Then, a lubricant is further added to the primarily mixed powder in which the alloying powder(s) or, optionally, the machinability improving powder(s), are adhered on the surface of the iron-based powder and mixed (referred to as secondary mixing) to form an iron-based mixed powder. The temperature for the secondary mixing is preferably lower than the minimum value among the melting points of the lubricants to be added for obtaining the lubrication function. The temperature is more preferably at a room temperature. Further, the amount of the lubricant to be added is preferably from about 0.1 parts by weight to about 0.8 parts by weight, more preferably, about 0.5 parts by weight or less based on 100 parts by weight of the total amount for a the iron-based powder, the alloying powder(s) and the machinability improving powder(s) (added optionally). The lubricant added by the secondary mixing forms a free lubricant and is present in a free state not bonded with the iron-based powder in the mixed powder.

The lubricant added upon secondary mixing as the free lubricant essentially contains one or more compounds selected from thermoplastic resin powder, zinc stearate and lithium stearate described above and, optionally, contains one or more of compounds selected from stearic acid, oleamide, stearamide, a melted mixture of stearamide and ethylenbis(stearamide), ethylenbis(stearamide), polyethylene with a molecular weight of about 10,000 or less, a melted mixture of ethylenbis(stearamide) and polyethylene with a molecular weight of about 10,000 or less. The thermoplastic resin powder preferably comprises 50 mass % or more, based on the thermoplastic resin powder, at least one compound selected from acrylic esters, methacrylic esters and aromatic vinyl compounds as the monomer, which is polymerized therewith.

In this invention, a portion of the reduced iron powder to be added as the iron-based powder, preferably, from about 10 to about 30 mass %, based on the entire amount of the iron-based powder, may be added during secondary mixing. This can make the reduced iron powder added upon secondary mixing as a free iron-based powder having no alloying powder(s) or machinability improving powder(s) adhered on the surface. When at least a portion of a reduced iron powder is a free iron-based powder, the die filling property of the iron-based mixed powder can be improved further remarkably.

Further, as another manufacturing method, the iron-based mixed powder according to this invention may be manufactured also by the following steps (1)–(4).

(1) After adding alloying powder(s) and, optionally, a machinability improving powder(s) to an iron-based powder substantially comprising from about 90 to about 60 mass % of an atomized iron powder, and from about 10 to about 40 mass % of a reduced iron powder and further spraying a liquid binder to such powders (the liquid binder is hereinafter referred to as a spray binder), they are mixed. As a liquid binder, one or more of oleic acid, spindle oil and turbine oil is preferably used.

(2) Zinc stearate is further added and mixed to the mixture to form a primary mixture. The amount of the zinc stearate, together with the spray binder, is preferably from about 0.1 to about 1.0 parts by weight of based on 100 parts by weight of the total amount for the iron-based powder, the alloying powder(s) and the machinability improving powder(s).

(3) The primary mixed powder is subjected to secondary mixing under heating at a temperature of from about 110 to about 150° C. A molten product by heating of zinc stearate and at least one of the spray binder is formed by the heating. When the heating temperature for secondary mixing is about 110° C. or higher, the function of the binder is fully provided to prevent segregation of the alloying powder(s). Further, when the heating temperature is about 150° C. or lower, lowering of the compressibility due to oxidation (hardening) of the iron-based powder can be prevented sufficiently from lowering.

Then, when the secondary mixed powder is cooled, the alloying powder(s) and, optionally, the machinability improving powder(s) are adhered firmly to the surface of the iron-based powder.

(4) A lubricant is further added to the secondary mixed powder in which the alloying powder(s) and, optionally, the machinability improving powder(s) are adhered to the surface of the iron-based powder and subjected to tertiary mixing to form an iron-based mixed powder. The temperature for the tertiary mixing is preferably lower than the lowest value of the melting points of the lubricants to be added. It is more preferably at a room temperature. Further, the amount of the lubricant to be added is preferably from about 0.1 to about 0.8 parts by weight based on 100 parts by weight of the total amount for the iron-based powder, the alloying iron powder and the machinability improving the powder. The lubricant added in the tertiary mixing forms a free lubricant, which is not substantially bonded with the iron-based powder and is present in a free state in the mixed powder.

The kind of the lubricant added in the tertiary mixing can be made identical to the free lubricant described above with no problems.

In the example of the manufacturing method described above, the treatment (1)–(3) constitutes the binder treatment.

A portion of the reduced iron powder mixed in the step (1) for the manufacturing method according to this invention, preferably, from about 10 to about 30 mass % based on the entire amount of the iron-based powder, may be added upon tertiary mixing (4). This can make the reduced iron powder added upon tertiary mixing as a free iron-based powder in which the alloy powder or the machinability improving powder(s) is not substantially adhered on the surface. When at least a portion of the reduced iron powder is formed as a free iron-based powder, the die filling property of the iron-based mixed powder can be further removed remarkably.

Further, the manufacturing method of the iron-based mixed powder according to this invention is not restricted only to the two examples of the manufacturing methods described above. As an example of the method other than the manufacturing methods described above, for example, after mixing the binder dissolved or dispersed in an organic solvent, the iron-based powder, the alloying powder(s) and, optionally, the machinability improving powder(s), the organic solvent is evaporated to adhere the alloying powder(s) and the machinability improving powder(s) to the surface of the iron-based powder (processes up to this step constitute the binder treatment) and then the lubricant is admixed to form an iron-based mixed powder in which the free lubricant is present.

The binder treatment is not restricted only to the method described above, but all of treatments conducted with an aim of adhering the starting powder other than the iron-based powder on the surface of the iron-based powder, are included in the binder treatment. It is important that a considerable amount of the alloying powder(s) or the machinability improving powder(s) is adhered to the iron-based powder for the effective binder treatment. For example, in a case of a graphite powder added frequently, it is preferred to conduct the binder treatment while selecting such a condition that about 60% or more (mass %) thereof is adhered.

For the iron-based mixed powder according to this invention, any of production process routes in usual powder metallurgy is applicable, such as pressing—sintering, pressing—sintering—carburized quenching (CQT), pressing—sintering—bright quenching (BQT), and pressing—sintering—induction quenching. In all of process route mentioned above, sizing process can be added if necessary.

EXAMPLE

Example 1

First, 974 g of iron-based powder, alloying powder(s) in the amount shown in TABLE 1, and the binder of the amount shown in TABLE 1, were charged in a heat mixing machine and mixed sufficiently to form a mixture.

As the iron-based powder, an atomized iron powder (KIP301A manufactured by Kawasaki Steel Corporation) and a reduced iron powder (255M manufactured by Kawasaki Steel Corporation) at a ratio shown in TABLE 1 q1were used. Each of them is a general iron powder for industrial use. Further, as the alloying powder(s), 6 g of a graphite powder with an average particle size of 23 μm, and 20 g of an electrolitic copper powder of an average particle size of 25 μm, were added. Further, as the binder, binders of the type and the amount shown in TABLE 1 were previously mixed and used. The content shown in TABLE 1 is represented by parts by weight based on 100 parts by weight of the total amount for the iron-based powder, the alloying powder(s) and, optionally, the machinability improving powder.

Then, the mixtures were heated while continuing mixing at the temperature shown in TABLE 1 (processes up to this steps are referred to as primary mixing) to form a primary mixture.

Successively, the primary mixture was cooled to 85° C. or lower while mixing. Further, after cooling to 40° C., free lubricants of the kind and the amount shown in TABLE 1 were added and after mixing so as to be homogenized (processes up to this step are referred as secondary mixing), the mixture was discharged from the heat mixing machine to form an iron-based mixed powder. TABLE 3 shows the relation between the symbols and the free lubricant except for thermoplastic resin powder, zinc stearate and lithium stearate added during secondary mixing. Further, TABLE 4 shows the relation between the symbols and the kinds of the thermoplastic resin powder used for the secondary mixing, the compositions, the polymerization method, the primary particle size, the agglomeration particle size and the molecular weight thereof.

A reduced iron powder (15 mass %) was added together with the lubricant during secondary mixing in a particular experiment (iron-based mixed powder: No. 1-17).

Die filling property, compressibility and segregation property were evaluated for the resultant iron-based mixed powder.

(1) Die filling property Test

Die filling property test for the iron-based mixed powder was conducted by using an apparatus schematically shown for the arrangement in FIG. 1. A shoe box (100×60×20 mm) filled with 150 g of an iron-based mixed powder (tested mixed powder) was moved at a speed of 200 mm/s in the direction of a mold, which was stopped just above a mold having a cavity thickness of 1 mm, kept for 1 second and then retracted after charging the iron-based mixture to the mold. After charging, pressing was conducted under a pressure of 488 MPa to form a green compact.

The weight for the green compacts was measured to determine the charged density {=(green compact weight)/(cavity volume)}. The value obtained by dividing the charged density by the apparent density of the iron-based mixed powder in the shoe box was defined as a charged value and the die filling property was evaluated. It was determined that the die filling property is improved as the charged value increases.

(2) Compressibility Test

Iron-based mixed powder (tested mixed powder) was pressed at a pressure of 5 ton/cm$^2$ (490 MPa) into a tablet of 25 mm diameter×20 mm height. The density (green density) of the green compact was measured to evaluate the compressibility.

(3) Segregation Test

Segregation of the graphite powder (a kind of alloying powder) contained in the iron-based mixed powder was investigated to evaluate the segregation property. The iron-based mixed powder (tested mixed powder) was sieved and carbon was quantitatively analyzed for the powder passing through a sieve of 100 mesh (150 μm) but not passing through 200 mesh (75 μm). Further, quantitative analysis was conducted also for the carbon of the entire iron-based mixed powder (tested mixed powder). From the results, the segregation property was evaluated using the degree of carbon adhesion defined as below.

Degree of carbon adhesion ={C analysis value for iron-based mixed powder with particle size passing through 100 mesh (150 μm) but not passing through 200 mesh (75 μm)}/(C analysis value for iron-based mixed powder)×100 (mass %).

Larger degree of carbon adhesion means less segregation of the graphite powder in the iron-based mixed powder. The results are shown TABLE 2.

TABLE 1

| | iron-based powder | | alloying powder (mass %) | | | heating | binder | | |
|---|---|---|---|---|---|---|---|---|---|
| iron-based mixed powder | atomized iron powder (mass %) | reduced iron powder (mass %) | copper powder | graphite powder | machinability improving powder (mass %) | temperature for primary mixing (° C.) | stearic acid mp: 69° C. (parts by weight) | oleamide mp: 76° C. (parts by weight) | stearamide mp: 103° C. (parts by weight) |
| 1-1 | 87.4 (89.7) | 10.0 | 2.0 | 0.6 | — | 120 | — | — | 0.15 |
| 1-2 | 82.4 (84.6) | 15.0 | 2.0 | 0.6 | — | 125 | — | — | 0.15 |
| 1-3 | 77.4 (79.5) | 20.0 | 2.0 | 0.6 | — | 125 | — | — | 0.15 |
| 1-4 | 67.4 (69.2) | 30.0 | 2.0 | 0.6 | — | 130 | — | — | 0.15 |
| 1-5 | 62.4 (64.1) | 35.0 | 2.0 | 0.6 | — | 130 | — | — | 0.15 |
| 1-6 | 87.4 (89.7) | 10.0 | 2.0 | 0.6 | — | 120 | 0.20 | — | — |
| 1-7 | 82.4 (84.6) | 15.0 | 2.0 | 0.6 | — | 125 | — | 0.40 | — |
| 1-8 | 82.4 (84.6) | 15.0 | 2.0 | 0.6 | — | 120 | — | — | 0.80 |
| 1-9 | 82.4 (84.6) | 15.0 | 2.0 | 0.6 | — | 136 | — | — | — |
| 1-10 | 77.4 (79.5) | 20.0 | 2.0 | 0.6 | — | 136 | — | — | — |
| 1-11 | 77.4 (79.5) | 20.0 | 2.0 | 0.6 | — | 114 | — | — | 0.20 |
| 1-12 | 77.4 (79.5) | 20.0 | 2.0 | 0.6 | — | 114 | — | — | 0.20 |
| 1-13 | 72.4 (74.3) | 25.0 | 2.0 | 0.6 | — | 130 | 0.10 | 0.10 | — |
| 1-14 | 72.4 (74.3) | 25.0 | 2.0 | 0.6 | — | 113 | — | — | 0.20 |
| 1-15 | 67.4 (69.2) | 30.0 | 2.0 | 0.6 | — | 147 | — | — | — |
| 1-16 | 67.4 (69.2) | 30.0 | 2.0 | 0.6 | — | 100 | — | 0.20 | 0.20 |
| 1-17 | 62.4 (64.1) | 10.0 + 15.0** | 2.0 | 0.6 | — | 140 | 0.20 | — | — |

TABLE 1-continued

| | | | | | | | | | |
|---|---|---|---|---|---|---|---|---|---|
| 1-18 | 60.4 (62.0) | 37.0 | 2.0 | 0.6 | — | 100 | — | 0.30 | 0.30 |
| 1-19 | 97.4 (100.0) | — | 2.0 | 0.6 | — | 100 | 0.20 | — | 0.30 |
| 1-20 | 94.4 (96.9) | 3.0 | 2.0 | 0.6 | — | 115 | 0.20 | — | — |
| 1-21 | 67.4 (69.2) | 30.0 | 2.0 | 0.6 | — | 100 | — | 0.40 | — |
| 1-22 | 67.4 (69.2) | 30.0 | 2.0 | 0.6 | — | 135 | 0.80 | — | — |
| 1-23 | 67.4 (69.2) | 30.0 | 2.0 | 0.6 | — | 115 | — | 0.30 | — |
| 1-24 | 67.4 (69.2) | 30.0 | 2.0 | 0.6 | — | 100 | 0.20 | — | 0.20 |
| 1-25 | 77.4 (79.5) | 20.0 | 2.0 | 0.6 | — | 114 | — | — | 0.09 |

| | binder | | | free lubricant | | | | | | |
|---|---|---|---|---|---|---|---|---|---|---|
| | melted mixture of | | | type: content (parts by weight) | | | | | | |
| | stearamide and | ethylenbis | | | | | | | | |
| iron-based mixed powder | ethylenbis (stearamide) mp: 125° C. (parts by weight) | (stearamide) mp: 142° C. (parts by weight) | total amount parts by weight | thermal plastic resin powder type | thermal plastic resin powder content | zinc stearate | lithium stearate | total amount: (parts by weight) | type: amount (parts by weight) | total amount (parts by weight) |
| 1-1 | — | 0.25 | 0.40 | A | 0.20 | 0.20 | — | 0.40 | — | 0.40 |
| 1-2 | — | 0.25 | 0.40 | A | 0.20 | 0.20 | — | 0.40 | — | 0.40 |
| 1-3 | — | 0.25 | 0.40 | A | 0.20 | 0.20 | — | 0.40 | — | 0.40 |
| 1-4 | — | 0.25 | 0.40 | A | 0.20 | 0.20 | — | 0.40 | — | 0.40 |
| 1-5 | — | 0.25 | 0.40 | A | 0.20 | 0.20 | — | 0.40 | — | 0.40 |
| 1-6 | — | — | 0.20 | — | — | 0.30 | — | 0.30 | a: 0.50 | 0.80 |
| 1-7 | — | — | 0.40 | C | 0.10 | — | — | 0.10 | f: 0.30 | 0.40 |
| 1-8 | — | — | 0.80 | D | 0.40 | — | — | 0.40 | d: 0.10, e: 0.10 | 0.60 |
| 1-9 | 0.50 | — | 0.50 | — | — | — | 0.20 | 0.20 | b: 0.10, c: 0.30 | 0.60 |
| 1-10 | 0.20 | 0.20 | 0.40 | F | 0.10 | 0.10 | — | 0.20 | e: 0.20 | 0.40 |
| 1-11 | 0.20 | — | 0.40 | G | 0.20 | 0.10 | — | 0.30 | g: 0.10 | 0.40 |
| 1-12 | 0.20 | — | 0.40 | — | — | — | 0.10 | 0.10 | a: 0.40 | 0.50 |
| 1-13 | — | 0.20 | 0.40 | B | 0.10 | 0.20 | 0.05 | 0.35 | c: 0.15 | 0.50 |
| 1-14 | 0.20 | — | 0.40 | C | 0.25 | — | — | 0.25 | f: 0.15 | 0.40 |
| 1-15 | — | 0.60 | 0.60 | D | 0.20 | 0.20 | — | 0.40 | — | 0.40 |
| 1-16 | — | — | 0.40 | A | 0.15 | — | 0.25 | 0.40 | — | 0.40 |
| 1-17 | — | 0.40 | 0.65 | A | 0.30 | — | — | 0.30 | d: 0.20 | 0.50 |
| 1-18 | — | — | 0.60 | G | 0.20 | — | — | 0.20 | f: 0.20 | 0.40 |
| 1-19 | — | — | 0.50 | B | 0.10 | — | — | 0.10 | b: 0.30 | 0.40 |
| 1-20 | 0.20 | — | 0.40 | — | — | 0.20 | — | 0.20 | d: 0.10 | 0.30 |
| 1-21 | — | — | 0.04 | A | 0.20 | — | — | 0.20 | a: 0.10 | 0.30 |
| 1-22 | — | 0.40 | 1.20 | C | 0.20 | — | — | 0.20 | c: 0.10 | 0.30 |
| 1-23 | 0.30 | — | 0.60 | D | 0.04 | — | — | 0.04 | — | 0.04 |
| 1-24 | — | — | 0.40 | B | 0.20 | — | — | 0.20 | f: 0.90 | 1.10 |
| 1-25 | — | — | 0.09 | B | 0.10 | 0.20 | 0.05 | 0.35 | f: 0.15 | 0.50 |

*) ( ) = [(atomized iron powder)/(iron-based powder)] × 100 (mass %)
**) free iron-based powder

TABLE 2

| | iron-based mixed powder characteristic | | | |
|---|---|---|---|---|
| iron-based mixed powder No. | die filling property charged value | compressibility green density ($Mg/m^3$) | segregation property carbon depositing degree (%) | remarks |
| 1-1 | 0.81 | 6.88 | 85 | this invention |
| 1-2 | 0.83 | 6.87 | 83 | |
| 1-3 | 0.85 | 6.86 | 85 | |
| 1-4 | 0.86 | 6.85 | 84 | |
| 1-5 | 0.87 | 6.83 | 83 | |
| 1-6 | 0.83 | 6.87 | 84 | |
| 1-7 | 0.84 | 6.86 | 86 | |
| 1-8 | 0.86 | 6.83 | 82 | |
| 1-9 | 0.85 | 6.84 | 84 | |
| 1-10 | 0.84 | 6.83 | 83 | |
| 1-11 | 0.83 | 6.85 | 86 | |
| 1-12 | 0.86 | 6.86 | 87 | |
| 1-13 | 0.85 | 6.84 | 85 | |
| 1-14 | 0.87 | 6.85 | 86 | |
| 1-15 | 0.86 | 6.84 | 83 | |
| 1-16 | 0.84 | 6.83 | 82 | |

TABLE 2-continued

| | iron-based mixed powder characteristic | | | |
|---|---|---|---|---|
| iron-based mixed powder No. | die filling property charged value | compressibility green density ($Mg/m^3$) | segregation property carbon depositing degree (%) | remarks |
| 1-17 | 0.91 | 6.83 | 85 | |
| 1-18 | 0.86 | 6.83 | 87 | |
| 1-19 | 0.35 | 6.90 | 86 | comparative |
| 1-20 | 0.40 | 6.89 | 88 | example |
| 1-21 | 0.82 | 6.87 | 36 | |
| 1-22 | 0.70 | 6.82 | 85 | this |
| 1-23 | 0.60 | 6.88 | 89 | invention |
| 1-24 | 0.65 | 6.80 | 84 | |
| 1-25 | 0.81 | 6.82 | 70 | |

TABLE 3

| symbol | type |
|---|---|
| a | stearic acid |
| b | oleamide |
| c | stearamide |
| d | melted mixture of stearamide and ethylenbis(stearamide) |
| e | ethylenbis(stearamide) |
| f | melted mixture of ethylenbis(stearamide) and polyethylene with molecular weight of 10,000 or less |
| g | polyethylene with molecular weight of 10,000 or less |

TABLE 4

| symbol for thermal plastic resin powder | manufacturing condition of thermal plastic resin powder | | | property of thermoplastic resin powder | | |
|---|---|---|---|---|---|---|
| | composition | compositional ratio (mass %) | polymerization method | average molecular weight ($10^4$) | primary particle size ($\mu$m) | agglomeration particle size |
| A | MMA | 100 | copolymerization | 40 | 0.04 | 30 |
| B | BA/MMA | 60/40 | core/shell two step polymerization | 200 | 1 | 40 |
| C | ST/BMA | 70/30 | copolymerization | 300 | 3 | 25 |
| D | MMA/BD | 85/15 | copolymerization | 80 | 0.08 | 15 |
| E | MMM/BMA | 70/30 | copolymerization | 60 | 0.4 | 30 |
| F | ST/AN | 80/20 | copolymerization | 100 | 0.3 | 20 |
| G | EA/ST | 60/40 | core/shell two step polymerization | 250 | 0.1 | 15 |

note *) MMA: methyl methacrylate
BMA: n-butyl methacrylate
EA: ethyl acrylate
BA: n-butyl acrylate
AN: acrylonitrile
BD: butadiene
ST: styrene It can be seen from TABLE 2 that each of the Examples according to preferable conditions of this invention (iron-based mixed powder No.1-1 to No. 1-18) is an iron-based mixed powder excellent in the die filling property and compressibility, with less segregation of graphite powder, as having a green density of 6.83 Mg/m$^3$ or more, a degree of carbon adhesion of 80% or more, and a charged value of 0.8 or more.

Iron-based mixed powder of this invention in less preferable conditions (Nos. 1-22 to 1-25) still has good die filling properties and compressibility, with less segregation of graphite powder, although somewhat lower than that in preferable conditions.

In the iron-based mixed powder in which the amount of the reduced iron powder is outside of the range of this invention (Nos. 1-19 and 1-20), the die filling property is lowered. Further, In the iron-based mixed powder (No. 1-21) in which the amount of the binder is remarkably insufficient and the purpose of the binder treatment can not be attained, the alloying powder(s) was not sufficiently adhered on the iron powder and, as a result, prevention for segregation was poor.

In the iron-based mixed powder (No. 1-25) in which the amount of the binder is lower than the preferred range of this invention segregation was increased. Further, in the iron-based mixed powder (No. 1-22) in which the amount of the binder is more than the suitable range of this invention, the die filling property was lower. Further, in the iron-based mixed powder (No. 1-23) in which the amount of the free lubricant is less than the preferred range of this invention, the die filling property was lowered. Further, in the iron-based mixed powder (No. 1-24) in which the amount of the free lubricant is much greater than the preferred range of this invention, the compressibility was lowered.

Example 2

First, primary mixing was conducted by spraying one or more kinds of members selected from oleic acid, spindle oil and turbine oil shown in TABLE 5 as a binder to 974 g of an iron-based powder, 6 g of a graphite powder having an average particle size of 23 $\mu$m as alloying powder(s) and 20 g of an electrolitic copper powder having an average particle size of 25 $\mu$m, and then mixing them. Further, the addition amount of the binder is represented by parts by weight based on 100 parts by weight of the total amount for the iron-based powder, the alloying powder(s) and, optionally, the machinability improving powder.

As the iron-based powder, an atomized iron powder (KIP301A manufactured by Kawasaki Steel Corporation) and a reduced iron powder (207M, manufactured by Kawasaki Steel Corporation) at a ratio shown in TABLE 5 were used. The iron powder used in this experiment was also a general iron powder for industrial use. Further, a graphite powder of an average particle size of 23 $\mu$m and an electrolitic copper powder of an average particle size of 25 $\mu$m were used as the alloying powder(s).

In the iron-based mixed powder No. 2-9, a MnS powder of an average particle size of 20 $\mu$m was added as the machinability improving powder instead of the copper powder.

Then, zinc stearate in an amount shown in TABLE 5 was further added as a binder to the primarily mixed powder and they were charged in a heat mixing machine and mixed thoroughly to form a mixture. The mixture was heated under mixing at a temperature of 140° C. to form a secondary mixture.

Successively, the secondary mixture was cooled while mixing to a temperature of 85° C. or lower. Further, after cooling to a temperature of 40° C., each free lubricant of the type and the amount shown in TABLE 5 was added and subjected to tertiary mixing so as to provide a homogeneous state and then discharged from the heat mixing machine to form an iron-based mixed powder. TABLE 3 shows, like Example 1, the relation between the symbols and the kinds of free lubricants other than the thermoplastic resin powder, zinc stearate and lithium stearate added upon tertiary mixing. Further, TABLE 4 shows, like Example 1, the relation between the symbols and the kinds of the thermoplastic resin powders used for tertiary mixing, compositions, polymerization methods, primary particle size, agglomeration particle size and the molecular weight thereof.

A reduced iron powder (15 mass %) was added together with the free lubricant upon tertiary mixing in a particular experiment (iron-based mixed powder No. 2-17).

For the resultant iron-based mixed powder, die filling property, compressibility and segregation property were evaluated in the same test method as in Example 1.

The obtained results are shown in TABLE 6.

TABLE 5

| iron-based mixed powder | iron-based powder: Atomized iron powder (mass %) | iron-based powder: reduced iron powder (mass %) | powder for mixture (mass %): copper powder | powder for mixture (mass %): graphite powder | machinability improving powder (mass %) | heating temperature for secondary mixing (° C.) | binder: oleic acid (parts by weight) | binder: spindle oil (parts by weight) | binder: turbine oil (parts by weight) | binder: zinc stearate (parts by weight) | total amount (parts by weight) |
|---|---|---|---|---|---|---|---|---|---|---|---|
| 2-1 | 87.4 (89.7) | 10.0 | 2.0 | 0.6 | — | 140 | 0.07 | — | — | 0.30 | 0.37 |
| 2-2 | 82.4 (84.6) | 15.0 | 2.0 | 0.6 | — | 140 | 0.10 | — | — | 0.50 | 0.60 |
| 2-3 | 77.4 (79.5) | 20.0 | 2.0 | 0.6 | — | 140 | 0.12 | — | — | 0.40 | 0.52 |
| 2-4 | 67.4 (69.2) | 30.0 | 2.0 | 0.6 | — | 140 | 0.15 | — | — | 0.35 | 0.40 |
| 2-5 | 62.4 (64.1) | 35.0 | 2.0 | 0.6 | — | 140 | 0.20 | — | — | 0.40 | 0.60 |
| 2-6 | 87.4 (89.7) | 10.0 | 2.0 | 0.6 | — | 140 | — | 0.06 | — | 0.50 | 0.56 |
| 2-7 | 82.4 (84.6) | 15.0 | 2.0 | 0.6 | — | 140 | — | — | 0.15 | 0.45 | 0.60 |
| 2-8 | 82.4 (84.6) | 15.0 | 2.0 | 0.6 | — | 140 | — | 0.07 | — | 0.35 | 0.42 |
| 2-9 | 82.4 (84.6) | 15.0 | — | 0.6 | 2.0 | 140 | — | 0.10 | 0.15 | 0.40 | 0.65 |
| 2-10 | 77.4 (79.5) | 20.0 | 2.0 | 0.6 | — | 140 | — | — | 0.20 | 0.70 | 0.90 |
| 2-11 | 77.4 (79.5) | 20.0 | 2.0 | 0.6 | — | 140 | — | 0.06 | — | 0.38 | 0.44 |
| 2-12 | 77.4 (79.5) | 20.0 | 2.0 | 0.6 | — | 140 | — | — | 0.07 | 0.50 | 0.57 |
| 2-13 | 72.4 (74.3) | 25.0 | 2.0 | 0.6 | — | 140 | 0.08 | — | — | 0.40 | 0.48 |
| 2-14 | 72.4 (74.3) | 25.0 | 2.0 | 0.6 | — | 140 | — | 0.10 | — | 0.35 | 0.45 |
| 2-15 | 67.4 (69.2) | 30.0 | 2.0 | 0.6 | — | 140 | — | — | 0.06 | 0.40 | 0.46 |
| 2-16 | 67.4 (69.2) | 30.0 | 2.0 | 0.6 | — | 140 | — | 0.12 | — | 0.35 | 0.47 |
| 2-17 | 62.4 (64.1) | 10.0 + 15.0** | 2.0 | 0.6 | — | 140 | 0.15 | — | — | 0.40 | 0.55 |
| 2-18 | 60.4 (62.0) | 37.0 | 2.0 | 0.6 | — | 140 | — | 0.10 | — | 0.35 | 0.45 |
| 2-19 | 97.4 (100.0) | — | 2.0 | 0.6 | — | 140 | 0.10 | — | — | 0.30 | 0.40 |
| 2-20 | 94.4 (96.9) | 3.0 | 2.0 | 0.6 | — | 140 | — | — | 0.10 | 0.35 | 0.45 |
| 2-21 | 67.4 (69.2) | 30.0 | 2.0 | 0.6 | — | 140 | 0.02 | — | — | 0.06 | 0.08 |
| 2-22 | 67.4 (69.2) | 30.0 | 2.0 | 0.6 | — | 140 | 0.10 | — | — | 1.30 | 1.40 |
| 2-23 | 67.4 (69.2) | 30.0 | 2.0 | 0.6 | — | 140 | 0.08 | — | — | 0.30 | 0.38 |
| 2-24 | 67.4 (69.2) | 30.0 | 2.0 | 0.6 | — | 140 | — | 0.06 | — | 0.35 | 0.41 |
| 2-25 | 67.4 (69.2) | 30.0 | 2.0 | 0.6 | — | 140 | — | — | 0.08 | 0.40 | 0.48 |
| 2-26 | 77.4 (79.5) | 20.0 | 2.0 | 0.6 | — | 140 | 0.01 | 0.04 | 0.01 | 0.38 | 0.44 |

| iron-based mixed powder | free lubricant: type: content (parts by weight): thermal plastic resin powder type | thermal plastic resin powder content | zinc stearate | lithium stearate | total amount: (parts by weight) | type: amount (parts by weight) | total amount (parts by weight) |
|---|---|---|---|---|---|---|---|
| 2-1 | — | — | 0.40 | — | 0.40 | — | 0.40 |
| 2-2 | — | — | 0.25 | — | 0.25 | — | 0.25 |
| 2-3 | — | — | 0.30 | — | 0.30 | — | 0.30 |
| 2-4 | — | — | 0.40 | — | 0.40 | — | 0.40 |
| 2-5 | — | — | 0.35 | — | 0.35 | — | 0.35 |
| 2-6 | A | 0.10 | — | — | 0.10 | a: 0.20 | 0.30 |
| 2-7 | B | 0.20 | — | — | 0.20 | b: 0.15 | 0.35 |
| 2-8 | C | 0.15 | — | 0.15 | 0.20 | f: 0.60 | 0.80 |
| 2-9 | A | 0.20 | — | — | 0.20 | c: 0.20 | 0.40 |
| 2-10 | B | 0.25 | — | — | 0.25 | d: 0.15 | 0.40 |
| 2-11 | D | 0.30 | — | 0.10 | 0.40 | g: 0.15 | 0.55 |
| 2-12 | E | 0.30 | — | — | 0.30 | f: 0.10 | 0.40 |
| 2-13 | F | 0.20 | — | — | 0.20 | e: 0.15 | 0.35 |
| 2-14 | — | — | — | 0.30 | 0.30 | — | 0.30 |
| 2-15 | — | — | — | 0.25 | 0.25 | — | 0.25 |
| 2-16 | G | 0.15 | — | — | 0.15 | b: 0.30, d: 0.05 | 0.50 |
| 2-17 | — | — | — | 0.15 | 0.15 | f: 0.20 | 0.35 |
| 2-18 | F | 0.20 | — | — | 0.20 | d: 0.10 | 0.30 |
| 2-19 | — | — | 0.40 | — | 0.40 | — | 0.40 |
| 2-20 | — | — | 0.40 | — | 0.40 | — | 0.40 |
| 2-21 | B | 0.20 | 0.10 | — | 0.30 | — | 0.30 |
| 2-22 | A | 0.20 | 0.10 | — | 0.30 | d: 0.15 | 0.45 |
| 2-23 | — | — | — | — | — | b: 0.20, c: 0.20 | 0.40 |
| 2-24 | C | 0.04 | — | — | 0.04 | — | 0.04 |

TABLE 5-continued

| | | | | | | | |
|---|---|---|---|---|---|---|---|
| 2-25 | D | 0.40 | — | — | 0.40 | d: 0.80 | 1.20 |
| 2-26 | E | 0.30 | — | 0.10 | 0.40 | g: 0.15 | 0.55 |

*) ( ) = [(atomized iron powder)/(iron-based powder)] × 100 (mass %)
**) free iron-based powder

TABLE 6

| iron-based mixed powder No. | iron-based mixed powder characteristic: die filling property charged value | compressibility green density ($Mg/m^3$) | segregation property carbon depositing degree (%) | remarks |
|---|---|---|---|---|
| 2-1 | 0.80 | 6.88 | 83 | this invention |
| 2-2 | 0.82 | 6.86 | 85 | |
| 2-3 | 0.83 | 6.86 | 86 | |
| 2-4 | 0.84 | 6.85 | 83 | |
| 2-5 | 0.87 | 6.83 | 86 | |
| 2-6 | 0.62 | 6.88 | 83 | |
| 2-7 | 0.82 | 6.85 | 82 | |
| 2-8 | 0.82 | 6.83 | 85 | |
| 2-9 | 0.84 | 6.86 | 86 | |
| 2-10 | 0.82 | 6.83 | 87 | |
| 2-11 | 0.83 | 6.86 | 86 | |
| 2-12 | 0.84 | 6.85 | 84 | |
| 2-13 | 0.83 | 6.85 | 82 | |
| 2-14 | 0.83 | 6.85 | 83 | |
| 2-15 | 0.84 | 6.85 | 83 | |
| 2-16 | 0.86 | 6.84 | 82 | |
| 2-17 | 0.86 | 6.83 | 85 | |
| 2-18 | 0.89 | 6.83 | 86 | |
| 2-19 | 0.33 | 6.90 | 84 | comparative example |
| 2-20 | 0.25 | 6.89 | 83 | |
| 2-21 | 0.82 | 6.90 | 35 | |
| 2-22 | 0.60 | 6.80 | 86 | this invention |
| 2-23 | 0.55 | 6.87 | 85 | |
| 2-24 | 0.60 | 6.89 | 85 | |
| 2-25 | 0.82 | 6.79 | 84 | |
| 2-26 | 0.83 | 6.85 | 85 | |

It can be seen that each of the Examples according to preferable conditions of this invention (iron-based mixed powder: No. 2-1 to No. 2-18, No. 2-26) is an iron-based mixed powder of excellent die filling property, compressibility and segregation-preventive property having a green density of 683 $Mg/m^3$ or more, a degree of carbon adhesion of 80% or more, and a charged value of 0.8 or more.

Iron-based mixed powder of this invention in less preferable conditions (Nos. 2-22 to 2-25) still has good die filling properties and compressibility, with less segregation of graphite powder, although somewhat lower than that in preferable conditions.

On the other hand, in the iron-based mixed powder with the amount of the reduced iron powder out of the range of this invention (Nos. 2-19 and 2-20), the die filling property was lowered. The iron-based mixed powder (No. 2-21) somewhat insufficient in the amount of the binder provided a result that the purpose of the binder treatment was not attained in which the alloying powder(s) was not sufficiently adhered to the alloying powder(s) making the prevention for the segregation insufficient in this experiment.

In the iron-based mixed powder (No. 2-22) in which the amount of binder is much greater than the suitable range of this invention, the die filling property was lowered. Further, in the iron-based mixed powder (No. 2-23) containing none of the thermoplastic resin, zinc stearate and lithium stearate as the free lubricant and thus out of the suitable range of this invention, the die filling property was lower. Further, in the iron-based mixed powder (No. 2-24) with the amount of the free lubricant lower than the suitable range of this invention, the die filling property was lowered. Further, in the iron-based mixed powder (No. 2-25) with the amount of the free lubricant being much greater than the suitable range according to this invention, the compressibility was lowered.

According to this invention, an iron-based mixed powder with less segregation, excellent in compressibility and also excellent in die filling property, can be manufactured at a reduced cost. The iron-based mixed powder according to this invention can provide outstanding industrial effects capable of consistently coping with the size reduction for sintered parts, and capable of producing sintered parts of high density consistently and with less fluctuation of characteristics, even when green compacts are produced by using molds having a narrow width cavity.

What is claimed is:

1. An iron-based mixed powder for use in powder metallurgy, comprising:

an iron-based powder;

at least one alloying powder;

binder; and optionally at least one machinability improving powder;

wherein the iron-based powder comprises, on the basis of mass %, from about 60% to about 90% of an atomized iron powder and from about 10% to about 40% of a reduced iron powder based on the entire amount of the iron-based powder;

wherein the alloying powder and the machinability improving powder are adhered by the binder on the surface of the iron-based powder.

2. The iron-based mixed powder of claim 1, wherein at least a portion of the reduced iron powder is present as a free iron-based powder in an amount, on the mass % basis, of from about 10% to about 30% based on the entire amount of the iron-based powder.

3. The iron-based mixed powder of claim 1, wherein the content of the binder is from about 0.1 parts by weight to about 1.0 parts by weight based on 100 parts by weight of the total amount for the iron-based powder, the at least one alloying powder and the at least one machinability improving powder.

4. The iron-based mixed powder of claim 1, wherein the binder comprises at least one compound selected from the group consisting of stearic acid, oleamide, stearamide, a melted mixture of stearamide and ethylenbis(stearamide) and ethylenbis(stearamide).

5. The iron-based mixed powder of claim 1, wherein the binder comprises zinc stearate and at least one of oleic acid, spindle oil and turbine oil.

6. The iron-based mixed powder of claim 1, wherein the iron-based mixed powder further comprises a free lubricant.

7. The iron-based mixed powder of claim 6, wherein the content of the free lubricant is from about 0.1 parts by weight to about 0.8 parts by weight based on 100 parts by weight of the total amount for the iron-based powder, the at least one alloying powder and the at least one machinability improving powder.

8. The iron-based mixed powder of claim 6, wherein the content of the free lubricant is from about 0.1 parts by weight to about 0.5 parts by weight based on 100 parts by weight of the total amount for the iron-based powder, the at least one alloying powder and the at least one machinability improving powder.

9. The iron-based mixed powder of claim 6, wherein the free lubricant comprises at least one compound selected from the group consisting of thermoplastic resin powder, zinc stearate and lithium stearate and, optionally, at least one compound selected from the group consisting of stearic acid, oleamide, stearamide, a melted mixture of stearamide and ethylenbis(stearamide), ethylenbis(stearamide), polyethylene with a molecular weight of about 10,000 or less and a melted mixture of ethylenbis(stearamide) and polyethylene with a molecular weight of about 10,000 or less.

10. The iron-based mixed powder of claim 9, wherein the thermoplastic resin powder comprises at least about 50 mass % with the thermoplastic resin powder of units of at least one monomer selected from the group consisting of acrylic esters, methacrylic esters, aromatic vinyl compounds and combinations thereof, wherein the monomer is polymerized, and wherein the thermoplastic resin powder has an average primary particle size of from about 0.03 $\mu$m to about 5.0 $\mu$m, an average agglomeration particle size of from about 5 $\mu$m to about 50 $\mu$m, and an average molecular weight measured by the specific viscosity of a solution of from about 30,000 to about 5,000,000.

11. An iron-based mixed powder for use in powder metallurgy, comprising:

an iron-based powder;

at least one alloying powder;

binder; and optionally at least one machinability improving powder, each being as starting material;

wherein the iron-based powder comprises from about 60 mass % to about 90 mass % of an atomized iron powder and from about 10 mass % to about 40 mass % of a reduced iron powder based on the entire amount of the iron-based powder; and wherein the alloying powder and the machinability improving powder are binder treated with the iron-based powder.

12. The iron-based mixed powder of claim 11, wherein the iron-based mixed powder further comprises a free lubricant.

13. An iron-based mixed powder for use in powder metallurgy, comprising:

an iron-based powder;

at least one alloying powder;

binder; and optionally at least one machinability improving powder, each being as starting material;

wherein the iron-based powder comprises from about 60 mass % to about 90 mass % of an atomized iron powder and from about 10 mass % to about 40 mass % of a reduced iron powder based on the entire amount of the iron-based powder;

wherein the alloying powder and the machinability improving powder are binder treated with at least a portion of the iron-based powder;

wherein the remainder of the iron-based powder substantially comprises reduced iron powder and is from about 10 mass % to about 30 mass % based on the entire amount of the iron-based powder, is mixed with binder-treated powder.

14. The iron-based mixed powder of claim 13, wherein the iron-based mixed powder further comprises a free lubricant.

* * * * *